US007207085B1

(12) United States Patent
Chen

(10) Patent No.: US 7,207,085 B1
(45) Date of Patent: Apr. 24, 2007

(54) EXTENDABLE PULL HANDLE FOR LUGGAGE

(76) Inventor: Shou Mao Chen, No. 344, Sec. 1, Chung Shan Road, Ta Cha Township, Taichung Hsien (TW)

( * ) Notice: Subject to any disclaimer, the term of this patent is extended or adjusted under 35 U.S.C. 154(b) by 110 days.

(21) Appl. No.: 11/051,102

(22) Filed: Feb. 7, 2005

(51) Int. Cl.
*A45C 3/00* (2006.01)

(52) U.S. Cl. ..... 16/113.1

(58) Field of Classification Search ..... 16/113.1, 16/405, 429; 190/115, 18 A; 280/655.1, 280/655, 47.371, 47.17; 403/109.3, 109.6, 403/109.7, 109.2, 109.5
See application file for complete search history.

(56) References Cited

U.S. PATENT DOCUMENTS 6,338,586 B1 * 1/2002 Kuo ..... 403/109.7
6,338,587 B1 * 1/2002 Kuo ..... 403/109.7
6,357,080 B1 * 3/2002 Tsai ..... 16/113.1
6,378,674 B1 * 4/2002 Lee ..... 190/115
6,470,529 B1 * 10/2002 Chang ..... 16/113.1
6,581,737 B2 * 6/2003 Wang ..... 190/115
6,609,271 B2 * 8/2003 Kuo ..... 16/113.1
6,827,186 B1 * 12/2004 Hsie ..... 190/115
6,918,476 B2 * 7/2005 Chou ..... 190/115
2003/0042092 A1 * 3/2003 Wang ..... 190/115

* cited by examiner

*Primary Examiner*—Chuck Y. Mah
(74) *Attorney, Agent, or Firm*—Egbert Law Offices

(57) ABSTRACT

The flexible fixation structure for the pull handle of luggage. At hollow tube base frames of the pull handle, some fixation members are mounted to enable the pull handle to be flexibly locked and fixed into upper and lower fixation holes of external hollow tube. The fixation member includes two snappers and two springs. The exterior of first snapper is fitted with the first projecting column, which is protruded and locked onto upper fixation hole of external hollow tube. And, an oblique guide plane is provided at the top of first snapper, and a concave surface at the inner side. At the center of the concave surface, a limit column is internally protruded. The exterior of second snapper is fitted with the second projecting column, which is protruded and locked onto lower fixation hole of external hollow tube.

2 Claims, 7 Drawing Sheets

EXTENDABLE PULL HANDLE FOR LUGGAGE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to luggage, and more particularly to innovative luggage designed with an extendable pull handle.

BACKGROUND OF THE INVENTION

The pull handles of luggage currently available are designed with a flexible structure, whereby the users can adjust them if necessary. The present invention is intended to improve a flexible structure for a wide array of pull handles of luggage, which lacks of smoothness and accuracy for locking and release of fixation columns (knobs), in spite of continuous development and innovation efforts by relevant operators in this industry. Since the so-called fixation column generally takes flexible components as its braking elements, mutual interference of acting force will likely occur in the case of two flexible components. This will lead to unsmooth operation during flexible positioning of pull handle, and repetitive pulling shall be required for a successful fixation, therefore affecting the value of product with inconvenience of operation.

Thus, to overcome the aforementioned problems of the prior art extendable pull handle of luggage, it would be an advancement in the art to provide an improved pull handle of luggage with an innovative structure.

BRIEF SUMMARY OF THE INVENTION

Based on the innovative structure design of first and second snapper 40, 50, the present invention can separate and limit the extension or contraction of two springs 60 70 against mutual interference, which is achieved by blocking/separation of guide slide plate 52 of the second snapper and the flexible connection of limit column 44 and pointing slot 53. Furthermore, it is possible to present a desirable locking and fixation behavior, thereby obtaining more smooth and accurate locking and fixation with declined hindrance and error rate.

DETAILED DESCRIPTION OF THE INVENTION

Figure 1:
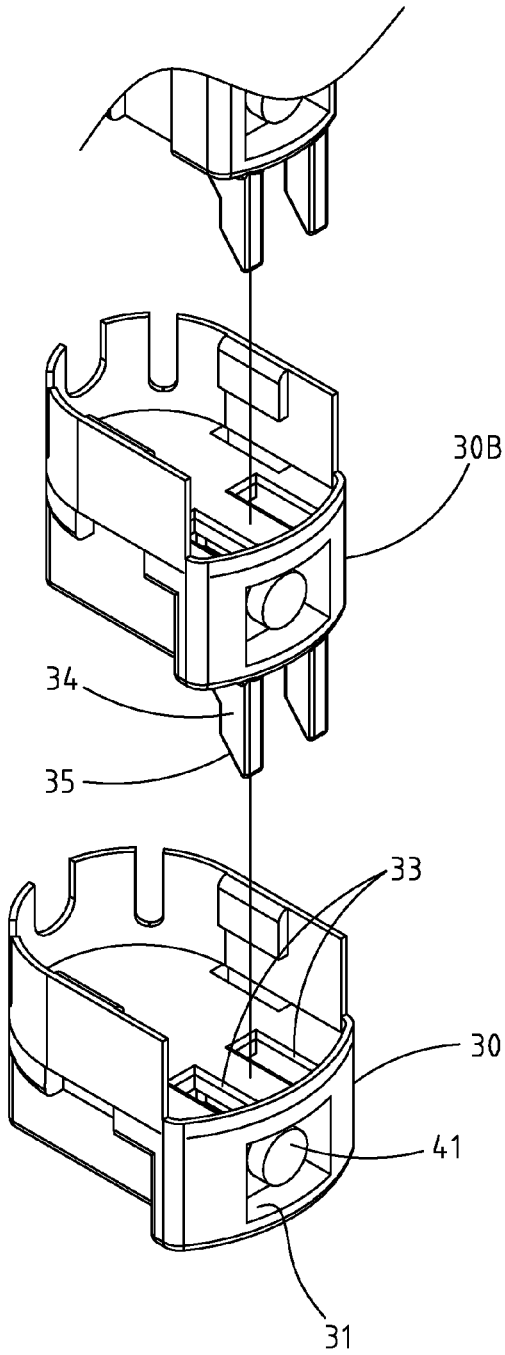
FIG. 1 shows an exploded perspective view of the base frame of the pull handle.

The features and the advantages of the present invention will be more readily understood upon a thoughtful deliberation of the following detailed description of a preferred embodiment of the present invention with reference to the accompanying drawings.

As shown in FIGS. 1–4, there is an extendable pull handle for luggage embodied in the present invention.

The invention includes a pull handle A, which is formed by several hollow tubes through internal and external pin joints. The base frame 30 of hollow tubes 10 20 is provided with an actuating slot 31, wherein some fixation members are placed. At both sides of hollow tube 20 facing externally there are separately provided with an upper fixation hole 21 and a lower fixation hole 22. In the event of extendable state for the above-specified hollow tube 10, it can be locked onto upper fixation hole 21 of external hollow tube 20 via the fixation member. In the event of contractible sate for the hollow tube 10, it can be locked onto lower fixation hole 22 of external hollow tube 20 via the fixation member. The so-called fixation member comprises two snapper and two springs.

The exterior of first snapper 40 is fitted with the first projecting column 41, which is protruded and locked onto upper fixation hole 21 of external hollow tube 20. And, an oblique guide plane 42 is provided at the middle top of first snapper 40, and a concave surface 43 at the inner side. At the center of the concave surface, a limit column 44 is internally protruded, of which limit column is designed with a T-shaped cylinder.

The exterior of second snapper 50 is fitted with the second projecting column 51, which is protruded and locked onto lower fixation hole 21 of external hollow tube 20. At the inner side of the second snapper 50, there is a guide slide plate 52 that can slide into actuating slot 31 of the base frame 30. At the top center of guide slide plate 52, there is a pointing slot 53 that allows for matching connection of limit column 44 of first snapper 40. Moreover, the limit column 44 can slide within the pointing slot 53 to a preset distance without release, while a flange 54 is formed at inner side of the guide slide plate 52.

The first spring 60 is supported between internal concave surface 43 of the first snapper 40 and internal flange 54 of the second snapper 50.

The second spring 70 is supported between outer face of guide slide plate 52 of second snapper 50 and blocking flange 32 at one side of actuating slot 31 of base frame 30.

Figure 2:
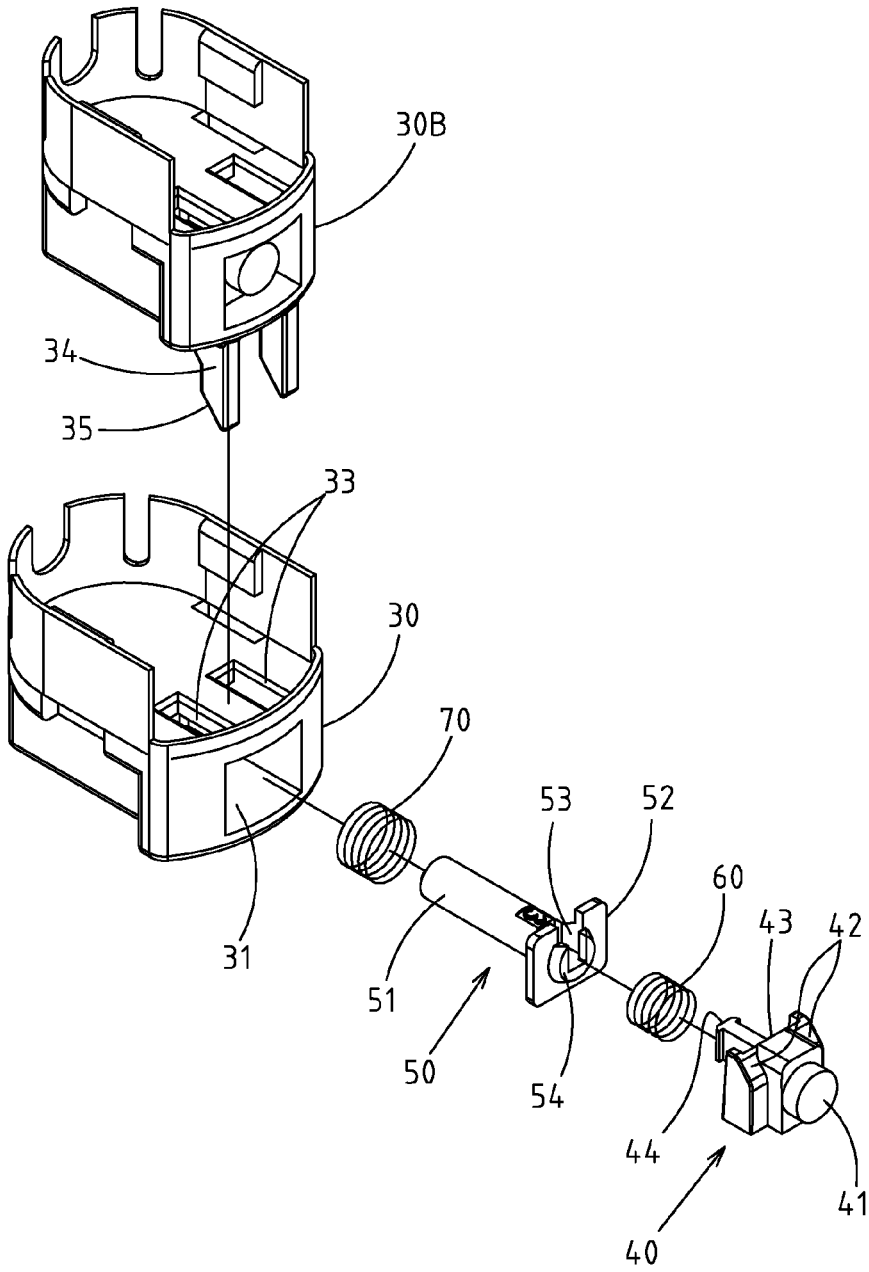
FIG. 2 shows another exploded perspective view of the internal fixation components of the base frame.

Besides, a through hole 33 is opened into oblique guide plane 42 of first snapper 40 opposite to the top of actuating slot 31 of hollow tube 10's frame 30, such that base frame 30B bottom of another upper hollow tube is provided with convex leg 34 (as shown in FIG. 2) opposite to above-specified through hole 33. An oblique edge 35 is mounted onto the bottom of the convex leg 34.

Based upon the aforementioned structure and composition, the innovative pull handle of luggage with a flexible structure can function as detailed below.

The pull handle of the present invention offers the same operating characteristics (extendable and contractible) as that of general pull handle of luggage. The major features of the present invention lie in the fixation structure.

Figure 3:
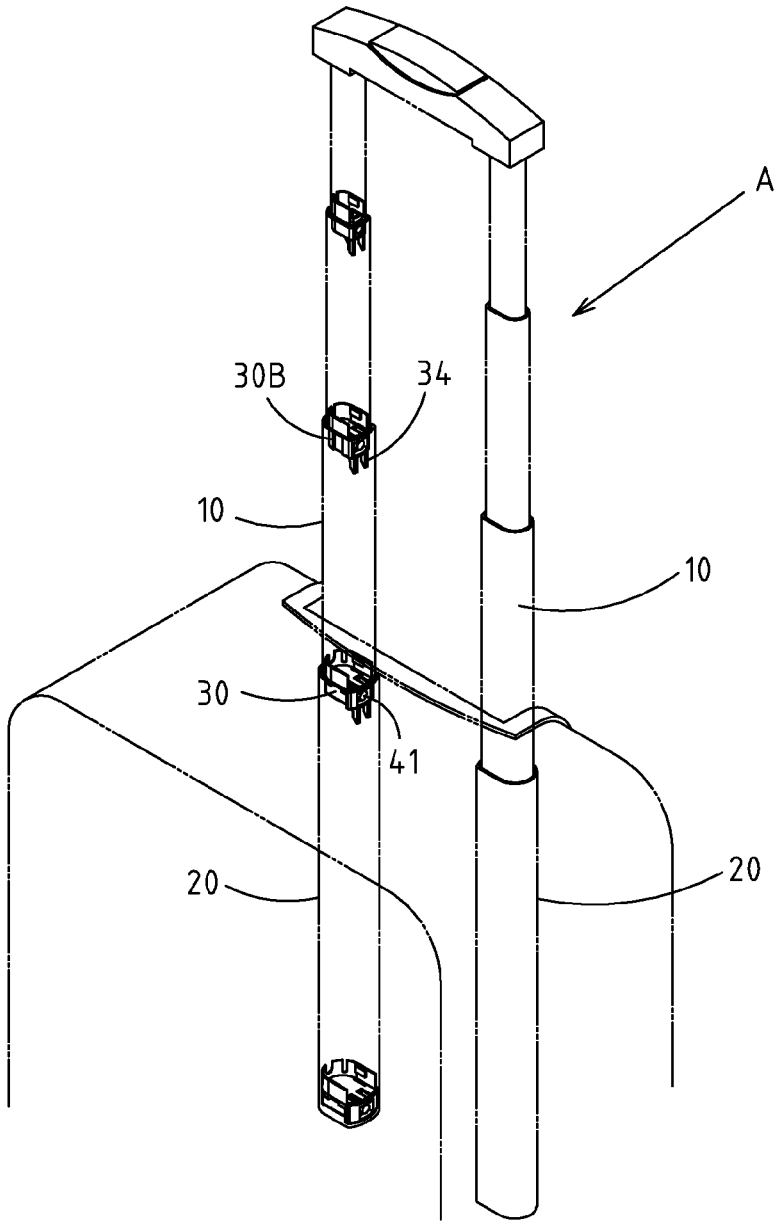
FIG. 3 shows a perspective view of a diagram of the assembly of the base frames and hollow tubes.
Figure 4:
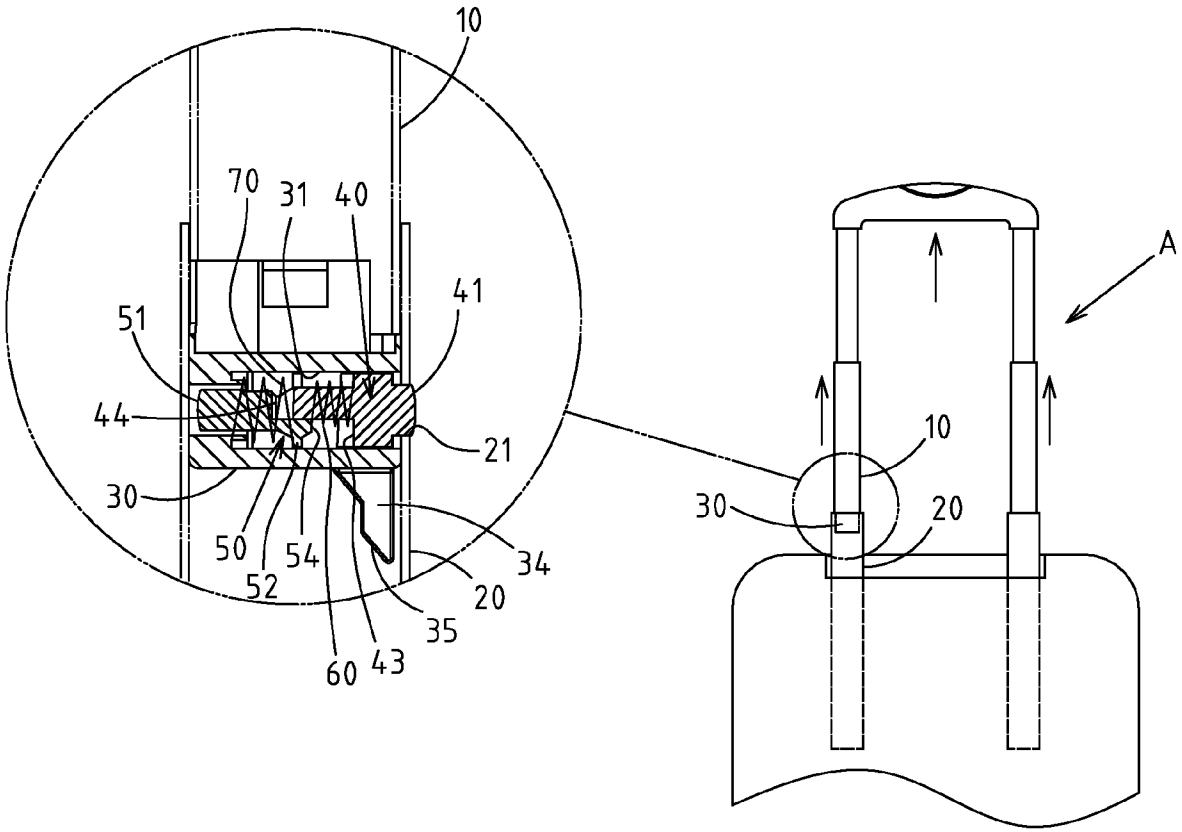
FIG. 4 shows a partial magnified sectional view and an elevation view of the pull handle at an extended state.
Figure 5:
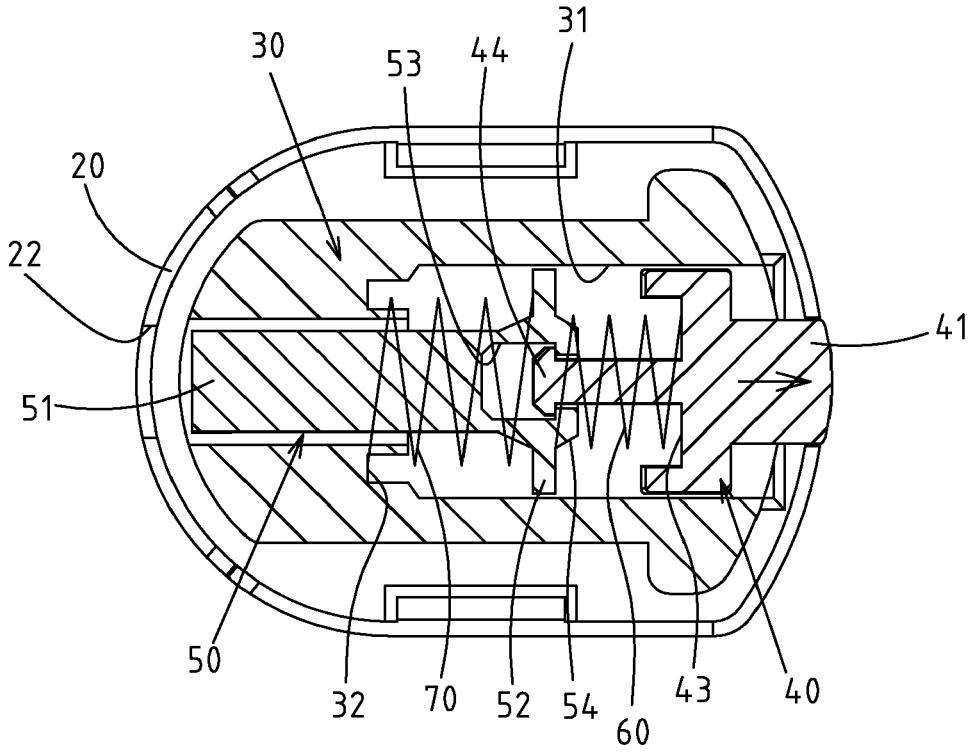
FIG. 5 shows a cross-sectional view of the fixation components according to FIG. 4.

As shown in FIGS. 3–5, the pull handle A is in an upwardly extendable state. In case where internal hollow tube 10 is pulled upward to the fixation position, and since no fixation hole allows for protrusion from the side wall of external hollow tube 20 opposite to second projecting column 51 of second snapper 50, the second snapper 50 will be pushed inward, thus pressing the first and second spring 60, 70. In such case, upper fixation hole 21 of another side wall at top of external hollow tube 20 is placed oppositely to the first projecting column 41 of the first snapper 40, such that the first projecting column can be protruded outward and then locked onto upper fixation hole 21 of external hollow tube 20, thus achieving a fixed pull handle A via the flexible release action of first and second spring 60 70.

Figure 6:
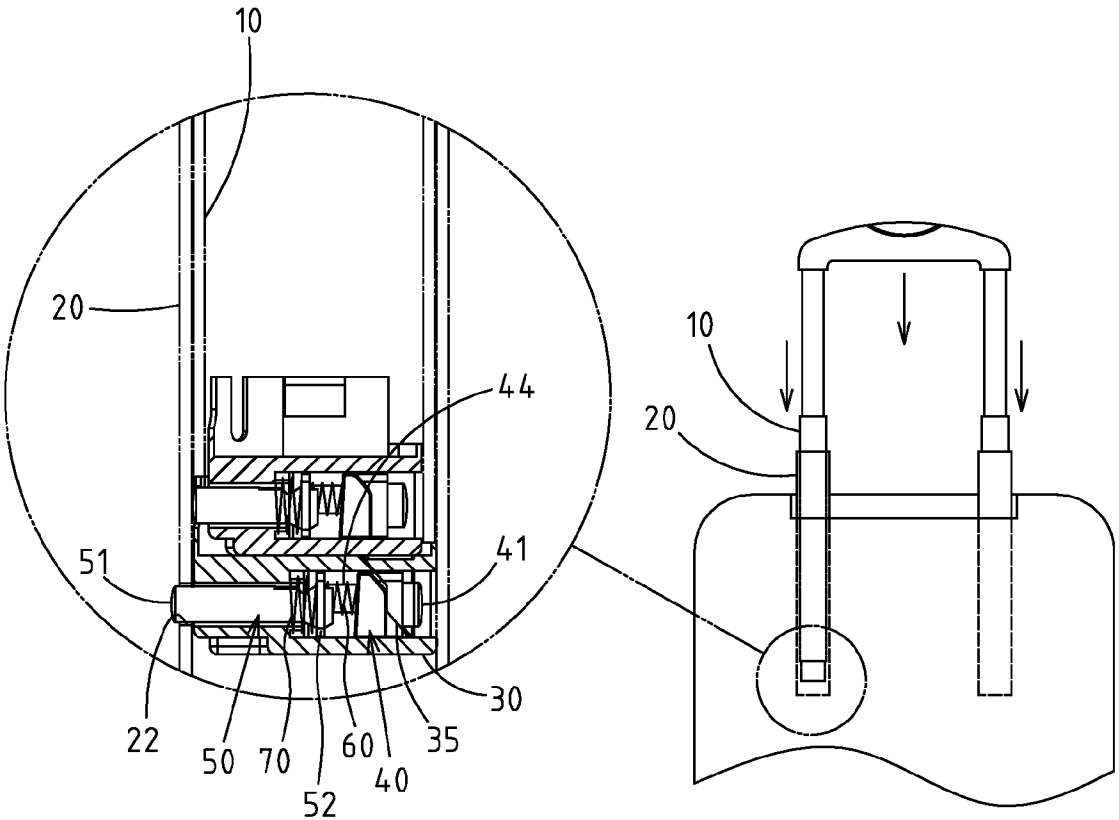
FIG. 6 shows a partial magnified sectional view and an elevation view of the pull handle at a contracted state.
Figure 7:
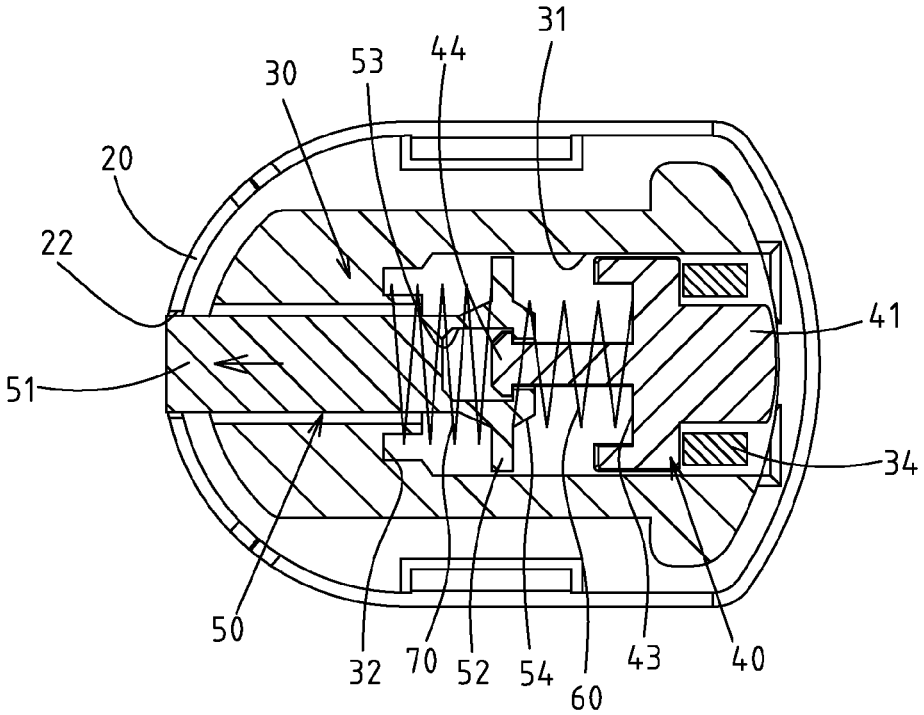
FIG. 7 shows a cross-sectional view of the fixation components according to FIG. 6.

Also, so shown in FIGS. 6–7, in case where hollow tubes 10 20 of pull handle A are in a contracted state, the convex leg 34 at a convex leg 34 of internal hollow tube 10 base frame 30 will penetrate the through hole 33 (i.e. external hollow tube) of lower base frame 30. Then, first snapper 40 is activated to slide towards the second snapper 50 through pushing oblique guide plane 42 by the oblique edge 35, thus enabling first projecting column 41 to be released from upper fixation hole 21 of external hollow tube 20. Meanwhile, squeezing first spring 60 will generate a pushing force to the second snapper 50. So, in case where internal hollow tube 10 declines to the fixation location, and since second projecting column 51 of second snapper 50 is placed oppositely to lower fixation hole 22 of external hollow tube 20, the first spring 60 is squeezed by the first snapper 40 at a bigger degree of force than for second spring 70. Thus, the second snapper 50 will slide outwards due to the flexible release action of first spring 60, thus enabling the second projecting column 51 to be locked into lower fixation hole 22 of external hollow tube for shortened fixation of pull handle A.

I claim:

1. An extendable pull handle assembly for luggage comprising:

a plurality of hollow tubes connected with internal and external pin joints; and a base frame receiving said plurality of hollow tubes, said base frame being formed of hollow tubular members, said plurality of hollow tubes having an actuating slot into which a fixation member is positioned, at least one of said hollow tubular members having an upper fixation hole and a lower fixation hole, said fixation member received in said upper fixation hole when said plurality of hollow tubes are in an extended position and received in said lower fixation hole when in a retracted position, said fixation member comprising:

a first snapper;

a second snapper;

a first spring; and a second spring, said first snapper having an exterior fitted with a first projecting column, said first projecting column locked onto said upper fixation hole, said first snapper having an oblique guide plane at a middle tap thereof, said first snapper having a concave surface at an inner side thereof, said first snapper having a limit column internally protruded at a center of said concave surface, said second snapper having a second projecting column fitted at an exterior thereof, said second projecting column being locked onto said lower fixation hole, said second snapper having a guide slide plate at an inner side thereof suitable for sliding into said actuating slot, said guide slide plate having a pointing slot at a top center thereof, said pointing slot suitable for mating connection with said limit column of said first snapper, said limit column suitable for sliding for a preset distance within said pointing slot, said guide slide plate having a flange formed on an inner side thereof, said first spring being supported between said concave surface of said first snapper and said flange of said second snapper, said second spring being supported between an outer face of said guide slide plate of said second snapper and a blocking flange at one side of said actuating slot, said oblique guide plane having a through hole formed opposite to a top of said actuating slot, said base frame having another hollow tubular member with a convex leg, said oblique guide plane having an oblique edge at a bottom thereof which extends through a lower through hole of said base frame, said first snapper being actuable so as to slide toward said second snapper by pushing on said oblique edge of said oblique guide plane so as to cause said first projecting column to be released from said upper fixation hole.

2. The assembly of claim 1, said limit column of said first snapper being a T-shaped cylinder.

* * * * *